US010738475B2

(12) United States Patent
Buoni et al.

(10) Patent No.: US 10,738,475 B2
(45) Date of Patent: Aug. 11, 2020

(54) WALL PANEL WITH RAIN SCREEN

(71) Applicant: Boral IP Holdings (Australia) PTY Limited, North Sydney (AU)

(72) Inventors: Wayne Joseph Buoni, Johns Creek, GA (US); David Chris Hines, Swanton, OH (US); Kenneth Bruns, Charlotte, NC (US)

(73) Assignee: Boral IP Holdings (Australia) PTY Limited, North Sydney (AU)

( * ) Notice: Subject to any disclaimer, the term of this patent is extended or adjusted under 35 U.S.C. 154(b) by 0 days.

(21) Appl. No.: 15/772,596

(22) PCT Filed: Oct. 30, 2015

(86) PCT No.: PCT/US2015/058341
§ 371 (c)(1),
(2) Date: May 1, 2018

(87) PCT Pub. No.: WO2017/074425
PCT Pub. Date: May 4, 2017

(65) Prior Publication Data

US 2019/0119925 A1 Apr. 25, 2019

(51) Int. Cl.
*E04F 13/14* (2006.01)
*E04F 13/00* (2006.01)
(Continued)

(52) U.S. Cl.
CPC ..... *E04F 13/007* (2013.01); *E04F 13/147* (2013.01); *E04C 2002/007* (2013.01); *E04F 13/0894* (2013.01)

(58) Field of Classification Search
CPC . E04F 13/007; E04F 13/0387; E04F 13/0846; E04F 13/0869; E04F 13/0871;
(Continued)

(56) References Cited

U.S. PATENT DOCUMENTS 1,681,634 A * 8/1928 Binder ..... E04F 13/0885 52/391
1,692,438 A * 11/1928 Gates ..... E04F 13/0803 52/141
(Continued)

FOREIGN PATENT DOCUMENTS

GB 1400185 A * 7/1975 ..... E04F 13/0875
WO 2000031357 A1 6/2000

OTHER PUBLICATIONS

International Search Report issued for PCT/US2015/058341, dated Jul. 28, 2016.

*Primary Examiner* — Kyle J. Walraed-Sullivan
(74) *Attorney, Agent, or Firm* — Bookoff McAndrews, PLLC

(57) ABSTRACT

A wall panel for installation on a supporting wall includes a facing surface that includes a plurality of separate and spaced apart design elements. The design elements define a channel therebetween. The panel also includes a backing surface having at least one rib opposite the channel. The rib extends transversely across the backing surface, such as a parallel to one of the upper or lower edges of the panel or at an angle between 0 and 90 relative to one of the upper or lower edges of panel. Fasteners are engagable through the channel and the rib for securing the wall panel to the supporting wall. Upon installation of the wall panel on the supporting wall, one or more air gaps are defined by the rib and the backing surface opposite the design elements. The rib provides additional material opposite the channel to prevent the panel from breaking during installation.

18 Claims, 5 Drawing Sheets

(51) Int. Cl.
*E04C 2/00* (2006.01)
*E04F 13/08* (2006.01)

(58) Field of Classification Search
CPC ..... E04F 13/0873; E04F 13/0889; E04F 13/0894; E04F 13/14; E04F 13/142; E04F 13/144; E04F 13/147; E04F 13/185; E04F 2201/023; E04F 17/023; E04F 17/026; E04F 17/04; E04B 1/7038; E04B 1/703; E04B 1/7053
See application file for complete search history.

(56) References Cited

U.S. PATENT DOCUMENTS 1,888,417 A * 11/1932 Aberson ..... E04F 13/147 52/314
1,889,091 A * 11/1932 Fried ..... E04F 13/147 52/315
1,931,709 A * 10/1933 Schaffert ..... E04F 13/0864 52/314
1,976,947 A * 10/1934 Krauss ..... E04F 13/007 52/284
2,046,213 A * 6/1936 Schnurer ..... E04C 2/40 249/83
2,087,931 A * 7/1937 Wallace ..... E04F 13/0803 52/387
2,156,149 A * 4/1939 Feichter ..... B28B 3/024 52/390
2,198,466 A * 4/1940 Stolze ..... E04F 13/0801 52/315
2,209,283 A * 7/1940 Ronzone ..... E04F 13/147 52/314
2,214,387 A * 9/1940 Snyder ..... E04F 13/147 427/202
2,300,258 A * 10/1942 Kublanow ..... E04F 13/0803 52/774
D135,475 S * 4/1943 Wright ..... 52/276
D135,476 S * 4/1943 Wright ..... D25/151
2,329,610 A * 9/1943 Harman ..... E04C 2/26 264/274
2,592,244 A * 4/1952 Chamberlain ..... E04F 13/147 52/314
2,660,217 A * 11/1953 Lawson ..... B28B 1/522 118/101
3,004,369 A * 10/1961 Findlay ..... E04F 13/0814 52/314
3,114,940 A * 12/1963 Higginbotham ..... E04F 15/04 267/153
3,142,938 A * 8/1964 Eberhardt ..... E04B 2/845 52/385
3,310,921 A * 3/1967 Forcadell ..... E04F 13/145 52/307
3,350,827 A * 11/1967 Sugar ..... E04C 2/26 156/71
3,435,577 A * 4/1969 O'Leary ..... E04F 13/147 156/71
3,496,694 A * 2/1970 Hicks ..... B28B 23/0012 264/34
3,524,790 A * 8/1970 Mason ..... B44F 9/04 156/71
3,533,206 A * 10/1970 Passeno, Jr. ..... E04F 13/08 156/71
3,613,326 A * 10/1971 Mollman ..... E04F 13/0871 52/309.1
3,621,625 A * 11/1971 Medow ..... B44F 11/04 156/71
3,646,715 A * 3/1972 Pope ..... B29C 44/1233 156/71
3,701,228 A * 10/1972 Taylor ..... E04F 13/0803 52/309.8
3,740,910 A * 6/1973 Taylor ..... B44F 9/04 428/15
3,905,170 A * 9/1975 Huettemann ..... E04B 2/14 52/314
3,908,326 A * 9/1975 Francis ..... E04F 13/0862 52/384
4,011,702 A * 3/1977 Matyas ..... E04F 13/0862 52/387
4,107,887 A * 8/1978 Wendt ..... E04B 1/86 52/105
4,589,241 A * 5/1986 Volpenhein ..... E04F 13/147 52/315
4,912,902 A * 4/1990 Weaver ..... B44C 1/28 52/314
5,060,433 A * 10/1991 Buryan ..... E04F 13/0835 52/235
5,373,676 A * 12/1994 Francis ..... E04F 13/0862 52/386
5,383,314 A * 1/1995 Rothberg ..... E02D 31/02 405/43
5,398,473 A * 3/1995 Chan ..... E04F 13/0812 52/235
5,673,529 A * 10/1997 Treister ..... E04C 2/288 52/235
5,715,637 A * 2/1998 Hesterman ..... E04B 1/942 52/309.8
5,833,895 A * 11/1998 Di Loreto ..... C10B 29/06 264/30
6,240,691 B1 * 6/2001 Holzkaemper ..... E04B 1/942 52/309.8
6,792,727 B2 * 9/2004 Krieger ..... E04C 2/328 52/235
6,802,165 B1 * 10/2004 Passeno ..... E04F 13/0862 52/288.1
D510,146 S * 9/2005 Attebery, II ..... D25/151
6,951,086 B2 * 10/2005 Passeno ..... E04F 13/0862 52/302.3
D588,284 S * 3/2009 Gleeson ..... D25/125
D601,720 S * 10/2009 Gleeson ..... D25/125
D603,533 S * 11/2009 Gleeson ..... D25/125
7,617,647 B2 * 11/2009 Turner ..... E04F 15/02183 52/385
D608,020 S * 1/2010 Gleeson ..... D25/125
7,871,054 B2 * 1/2011 Walters ..... B28B 19/0061 249/15
8,151,530 B2 * 4/2012 Schwarz ..... E04F 13/185 52/314
8,322,103 B1 * 12/2012 Kownacki ..... E04F 13/0733 52/235
9,464,442 B1 * 10/2016 Olczyk ..... E04F 13/0862
9,512,621 B1 * 12/2016 Trezza ..... E04F 13/0803
10,011,990 B2 * 7/2018 Collins ..... E04F 13/047
2004/0221530 A1 * 11/2004 Winberry ..... B44C 5/0446 52/311.1
2005/0097858 A1 * 5/2005 Miedzianowski .. E04F 13/0862 52/782.1
2005/0188642 A1 * 9/2005 Correia ..... E04F 13/0862 52/506.1
2005/0204666 A1 * 9/2005 Passeno ..... E04F 13/0862 52/384
2006/0053743 A1 * 3/2006 Hatzinikolas ..... E04F 13/0855 52/782.1
2006/0156668 A1 * 7/2006 Nasvik ..... B32B 3/06 52/516
2006/0201092 A1 * 9/2006 Saathoff ..... E04F 13/00 52/385
2006/0265988 A1 * 11/2006 Fujito ..... E04F 13/0803 52/511
2007/0039265 A1 * 2/2007 Arcand ..... E04C 2/049 52/314
2007/0051069 A1 * 3/2007 Grimes ..... E04B 1/7069 52/782.1
2007/0137128 A1 * 6/2007 Viau ..... B44C 5/0415 52/388
2007/0151190 A1 * 7/2007 Huff ..... E04F 13/0846 52/592.5
2007/0289236 A1 * 12/2007 Choi ..... E04F 13/0803 52/311.2

(56) References Cited

U.S. PATENT DOCUMENTS

2008/0155921 A1* 7/2008 Wolf ..... B28B 23/0062 52/386
2008/0155922 A1* 7/2008 Wolf ..... E04F 13/0862 52/386
2008/0313988 A1* 12/2008 MacDonald ..... E02D 29/02 52/385
2009/0193742 A1* 8/2009 Wolf ..... E04F 13/147 52/311.1
2009/0235600 A1* 9/2009 Logan ..... B28B 7/0073 52/314
2009/0249719 A1* 10/2009 Broehl ..... E04F 13/147 52/250
2009/0313935 A1* 12/2009 Montgomery ..... E04F 13/081 52/506.1
2010/0101159 A1* 4/2010 Gleeson ..... E04B 1/66 52/105
2010/0107531 A1* 5/2010 Hunsaker ..... E04F 13/0862 52/314
2010/0132288 A1* 6/2010 Hines ..... E04F 13/08 52/302.6
2010/0218447 A1* 9/2010 Gehring ..... B28B 7/007 52/435
2010/0325993 A1* 12/2010 Bolin ..... B29C 44/10 52/309.4
2011/0154759 A1* 6/2011 Wilson ..... E04F 13/0864 52/302.1
2011/0162309 A1* 7/2011 Leach ..... B28B 3/06 52/415
2011/0173922 A1* 7/2011 Buoni ..... E04F 13/0803 52/717.01
2011/0175255 A1* 7/2011 Wernette ..... B28B 7/007 264/271.1
2011/0175256 A1* 7/2011 Wernette ..... E04F 13/147 264/316
2012/0085052 A1* 4/2012 Bouchard ..... E04F 13/0862 52/302.1
2012/0096790 A1* 4/2012 Wilson ..... E04F 13/0864 52/302.1
2012/0247040 A1* 10/2012 Buoni ..... E04B 1/70 52/302.1
2013/0097950 A1* 4/2013 Hunsaker ..... E04F 13/0733 52/309.1
2013/0160393 A1* 6/2013 Steinmetz ..... E04C 5/00 52/704
2013/0216797 A1* 8/2013 Lerch ..... E04F 13/165 428/211.1
2013/0276392 A1* 10/2013 Johnson ..... E04F 13/04 52/302.1
2014/0041331 A1* 2/2014 Buoni ..... E04F 13/0733 52/506.01
2014/0150614 A1* 6/2014 Aboukhalil ..... E04F 13/007 83/39
2015/0021822 A1 1/2015 Wolf et al.
2015/0040509 A1* 2/2015 Peltola ..... B29C 48/022 52/582.1
2015/0047281 A1* 2/2015 Cole ..... E04F 13/148 52/302.1
2016/0010341 A1* 1/2016 Deangelis ..... E04F 13/0885 52/389
2016/0024788 A1* 1/2016 Grisolia ..... A47K 3/008 52/302.1
2016/0145875 A1* 5/2016 Scully ..... E04F 13/0807 52/698
2016/0153198 A1* 6/2016 Hatzinikolas ..... E04B 1/40 52/702
2016/0201314 A1* 7/2016 Hatzinikolas ..... F16M 13/02 248/220.22
2016/0319555 A1* 11/2016 Norwood ..... E04F 13/007
2017/0211280 A1* 7/2017 Hubbard ..... E04F 13/0875

* cited by examiner

WALL PANEL WITH RAIN SCREEN

CROSS-REFERENCE TO RELATED APPLICATIONS

This application is the 35 U.S.C. § 371 national stage application of PCT Application No. PCT/US2015/058341, filed Oct. 30, 2015, which is hereby incorporated herein by reference in its entirety.

BACKGROUND

Prefabricated or cast veneer wall panels have been developed as a quick and efficient way to provide a masonry appearance for a building while simplifying construction and lowering construction cost. The design elements of prefabricated wall panels typically simulate brick, stone, tile and other masonry building components or materials commonly used in the construction of buildings. Examples of prefabricated wall panels are disclosed in U.S. Pat. No. 3,142,938 to Eberhardt, U.S. Pat. No. 4,669,238 to Kellis et al, U.S. Pat. No. 5,379,561 to Saito, U.S. Pat. No. 5,673,529 to Treister et al, U.S. Pat. No. 7,997,039 to Wolf et al., U.S. Pat. No. 8,042,309 to Wolf et al., U.S. Pat. No. 8,782,988 to Wolf et al, U.S. Published Patent Application No. 2007/0137128 to Viau et al, and U.S. Published Patent Application No. 2008/0155938 to Attebery et al.

Prefabricated wall panels are typically made from reinforced construction materials such as fiberglass reinforced concrete. Prefabricated wall panels made from such reinforced materials are resistant to damage from handling during packaging, shipping and installation. However, further improvements in durability to decrease loss due to breakage during shipment and installation are still desired.

U.S. Pat. No. 7,997,039 to Wolf et al., U.S. Pat. No. 8,042,309 to Wolf et al., U.S. Pat. No. 8,782,988 to Wolf et al. relate to prefabricated wall panels that include a mounting element that extends from an edge of the panel. Fasteners are engaged through the mounting element to secure the panel to a wall structure. The mounting element enhances durability and provides improved handling characteristics. However, the mounting element may limit how the panel may be secured to the wall structure.

U.S. Published Patent Application No. 2008/0155938 to Attebery et al. relates to a fiber-reinforced panel for mounting to an exterior wall of a building. The panel includes a plurality of masonry units that are spaced apart from each other on a face of the panel and grooves that are defined between the masonry units. The panel is secured to the wall of the building by engaging fasteners through the grooves, and then mortar is injected into the grooves, hiding the fasteners. However, the grooves through which the fasteners are engaged are prone to breaking during installation and shipment.

Accordingly, there is a need in the art for an improved wall panel structure.

BRIEF SUMMARY

According to various implementations, an improved wall panel for installation on a supporting wall includes a facing surface and a backing surface. The facing surface includes a plurality of design elements that are separate and spaced apart from each other and extend outwardly from the facing surface in a first direction. The design elements define a channel therebetween. The backing surface includes at least one rib that extends away from the backing surface in a second direction. The second direction is opposite the first direction, and the rib is disposed opposite at least a portion of the channel such that a plane extending parallel to the first and second directions extends through a central portion of the channel and the rib. One or more fasteners are engagable through the channel and the rib for securing the wall panel to the supporting wall. Upon installation of the wall panel on the supporting wall, the facing surface faces outwardly relative to the supporting wall, the backing surface faces toward the supporting wall, and one or more air gaps are defined by the rib and the backing surface opposite the design elements. The rib increases the flexural strength of the wall panel and provides additional material opposite the channel to prevent breakage of the panel and provide strength during and after installation.

According to some implementations, a longitudinal axis of the rib extends transversely across the backing surface. The longitudinal axis may be parallel or at an angle between 0° and 90° relative to an upper or lower edge of the panel. In addition, the panel may include a plurality of ribs. In some implementations, the longitudinal axes of the ribs extend parallel to each other.

Furthermore, in some implementations, each rib includes a proximal surface adjacent the backing surface and a distal surface spaced apart from the proximal surface, and a thickness of each rib at the proximal surface is greater than a thickness of the rib at the distal surface. For example, in one implementation, the rib may define a trapezoidal shaped cross section as viewed from a side edge of the wall panel.

In addition, each rib defines one or more drainage channels along a distal surface of the rib, according to certain implementations. The drainage channels extend vertically along relative to the supporting wall upon installation of the wall panel on the supporting wall to allow moisture between the wall panel and the supporting wall to flow and drain out of the system. In implementations in which there are a plurality of drainage channels, the drainage channels may be spaced apart from each other along a length of the rib.

In some implementations, the design elements are separately formed from the facing surface.

The wall panel also includes a lower edge surface having a first thickness and an upper edge surface having a second thickness, according to certain implementations. The lower edge surface and the upper edge surface are opposite and spaced apart from each other, and an edge rib extends from one of the lower edge surface or the upper edge surface in a direction parallel to the first and second directions. In some implementations, the edge rib defines a groove, and a second plane that is parallel to the backing surface extends through a central portion of the groove. The other edge surface defines a tongue that extends outwardly from the other edge surface in a direction parallel to the second plane. And, the tongue of a first wall panel is configured for engaging the groove of a second wall panel. Furthermore, the one or more air gaps includes a first air gap, and upon installation of the wall panel on the supporting wall, the rib and the edge rib are disposed against the supporting wall, and the rib, the edge rib, and the backing surface between the rib and the edge rib define the first air gap with the supporting wall.

The backing surface and facing surface also define at least one opening extending through the wall panel, according to some implementations. A central axis of the opening extends through one of the design elements. In addition, in certain implementations, each opening has a first diameter at the backing surface and a second diameter at the facing surface, wherein the first diameter is larger than the second diameter.

According to some implementations, the wall panel may have a thickness as defined between the facing surface and the backing surface of between about ⅛ inches to about 1 inch, a thickness defined between a proximal surface of the rib and a distal surface of the rib is about ⅛ inches to about 1 inch, and/or an overall thickness of the wall panel between the facing surface and a distal end of the rib is about ¼ to about 2 inches.

BRIEF DESCRIPTION OF THE DRAWINGS

The systems and methods are explained in detail in the following exemplary drawings. The drawings are merely exemplary to illustrate the structure of exemplary systems and methods and certain features that may be used singularly or in combination with other features. The invention should not be limited to the implementations shown.

DETAILED DESCRIPTION

Figure 1:
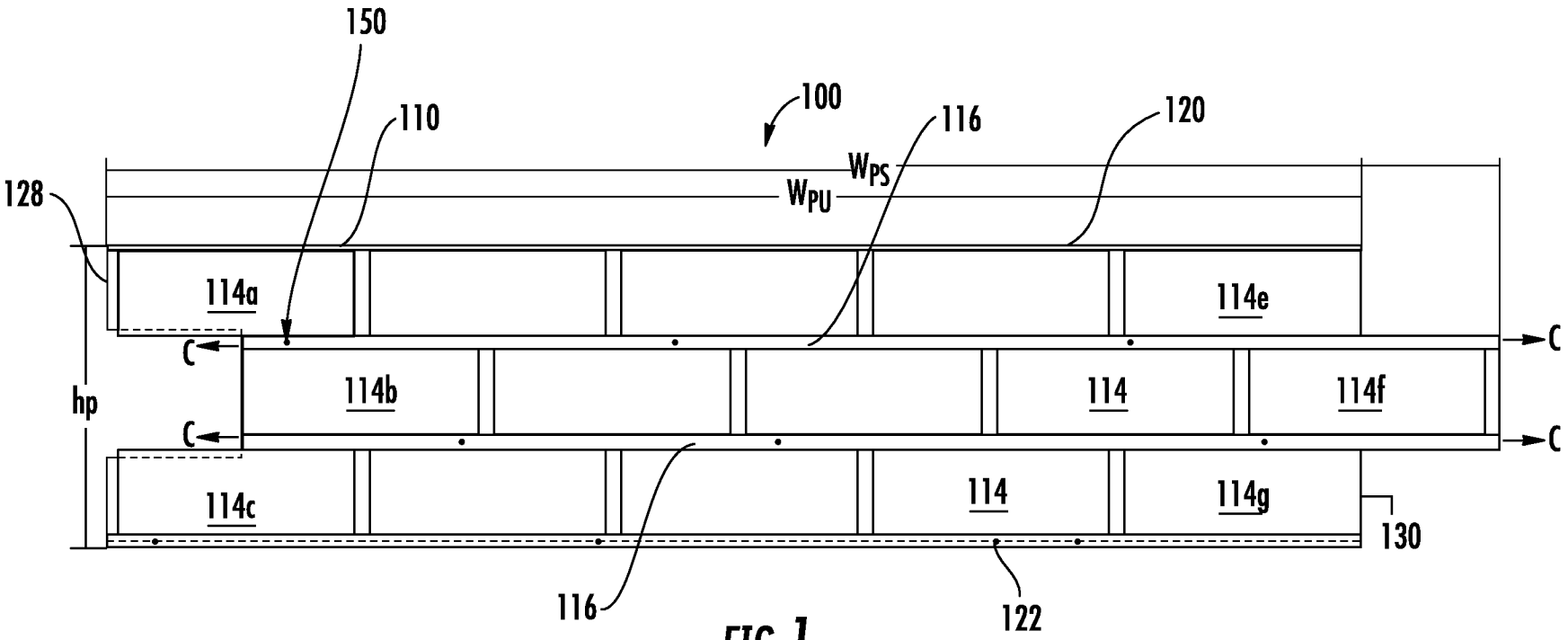
FIG. 1 illustrates a front view of a wall panel according to one implementation.
Figure 2:
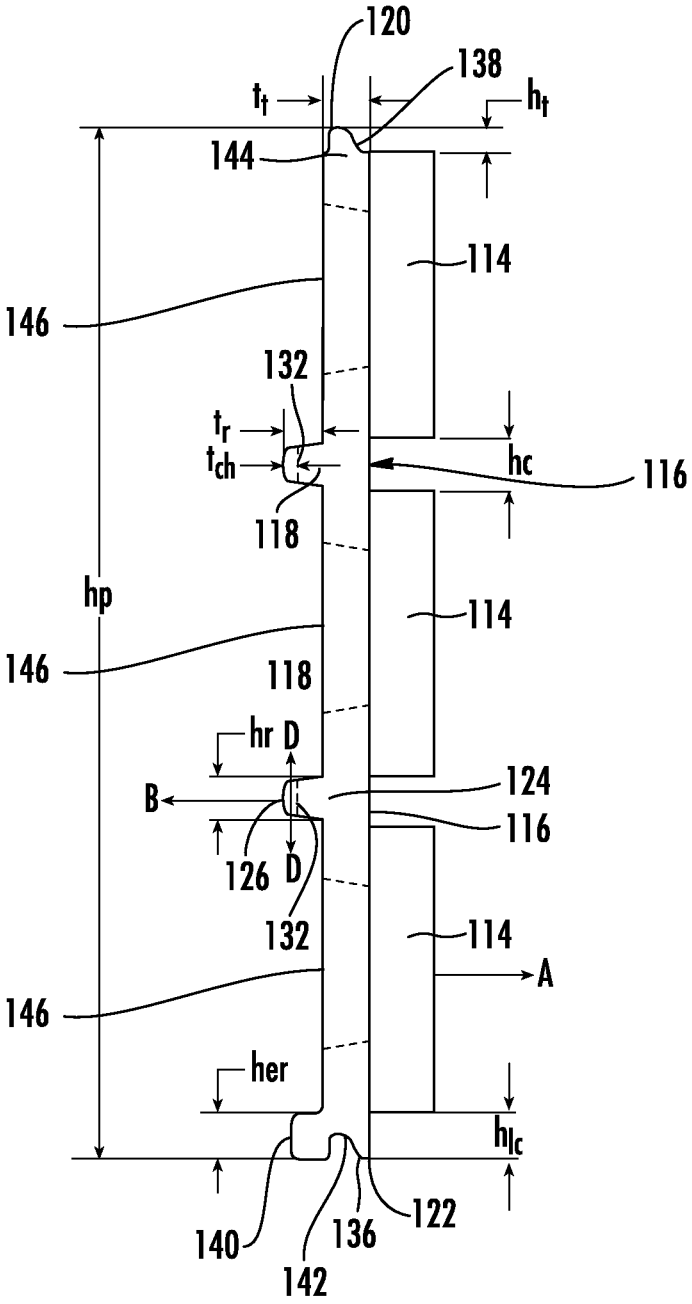
FIG. 2 illustrates a side view of the wall panel shown in FIG. 1.

According to various implementations, an improved wall panel for installation on a supporting wall includes a plurality of design elements on a facing surface and one or more ribs on a backing surface. The ribs are disposed opposite thinner portions of the panel to improve the panel's flexural strength, reduce material usage, and prevent breakage and provide strength during and after installation. The ribs also allow moisture to drain or escape from the air gap defined by the ribs, the backing surface between the ribs, and the wall structure on which the panel is installed.

In particular, the design elements extend outwardly in a first direction from the facing surface and are separate and spaced apart from each other, defining a channel between them. Each rib extends outwardly from the backing surface in a second direction that is opposite the first direction. The ribs are disposed opposite at least a portion of one or more of the channels defined between the design elements such that a plane extending parallel to the first and second directions extends through a central portion of the respective channel and rib.

The wall panel is secured to the supporting wall by engaging one or more fasteners through one or more of the channels and the rib opposite the respective channel. Upon installation of the wall panel on the supporting wall, one or more air gaps are defined by each rib and the backing surface opposite the design elements. And, in some implementations, the ribs also define drainage channels that allow moisture to escape from these air gaps.

By having the ribs be disposed opposite the channels on the facing surface, the amount of material used is optimized to provide increased strength opposite the fastening areas to prevent breakage during installation and to provide increased flexural strength for the panel during shipping and installation.

A wall panel 100 according to one implementation in shown in FIGS. 1 through 4. The wall panel 100 includes a facing surface 110 and a backing surface 112. A plurality of design elements 114 extend outwardly from the facing surface 110 in a first direction A, and a plurality of horizontally oriented channels 116 are defined between adjacent courses of the design elements 114. Opposite the horizontally oriented channels 116 are one or more ribs 118 that extend outwardly from the backing surface 112 in a second direction B, which is opposite of direction A. In some implementations, a height $h_c$ of each channel 116 may be about 0.5 inches.

In the implementation shown in FIGS. 1 through 4, each rib 118 extends continuously and transversely across a width of the panel. For example, as shown in FIGS. 1 through 4, a longitudinal axis C-C of each rib 118 extends parallel to an upper edge 120 and a lower edge 122 of the panel 100. However, in other implementations, the longitudinal axis C-C may be at an angle between 0° and 90° relative to the upper 120 or lower edges 122. For example, in one implementation, the longitudinal axis of the ribs may be at an angle of about 45° relative to the upper and lower edges of the panel. In addition, the ribs may be discontinuous along the width of the panel. In other words, the ribs may include two or more sections of ribs that extend opposite a particular channel.

Furthermore, in some implementations, the channels 116 may include visual marks 150 that indicate where fasteners are to be engaged through the channels 116. For example, the marks 150 may be spaced apart 16 inches for installations in which the fasteners are to be engaged 16 inches apart.

In addition, each rib 118 includes a proximal surface 124 adjacent the backing surface 112 and a distal surface 126 spaced apart from the proximal surface 124. A height of each rib 118 at the proximal surface 124 is greater than a height of the rib 118 at the distal surface 126. For example, in the implementation shown in FIGS. 1 through 4, the rib 118 defines a trapezoidal shaped cross section as viewed from a side edge 128, 130 of the wall panel 100. However, in other implementations, the shape of the ribs may have an arcuate shaped cross section, a triangular shaped cross section, a rectangular shaped cross section, or any other suitable shape.

According to some implementations, a thickness $t_r$ of the ribs 118 as measured from the proximal surface 124 to the distal surface 126 may be about 0.4 inches, and a height $h_r$ of each rib 118 as measured at the proximal surface 124 may be about 0.4 inches. Furthermore, ribs 118 may be spaced apart about 3 to about 3.5 inches from center, according to some implementations.

Figure 3:
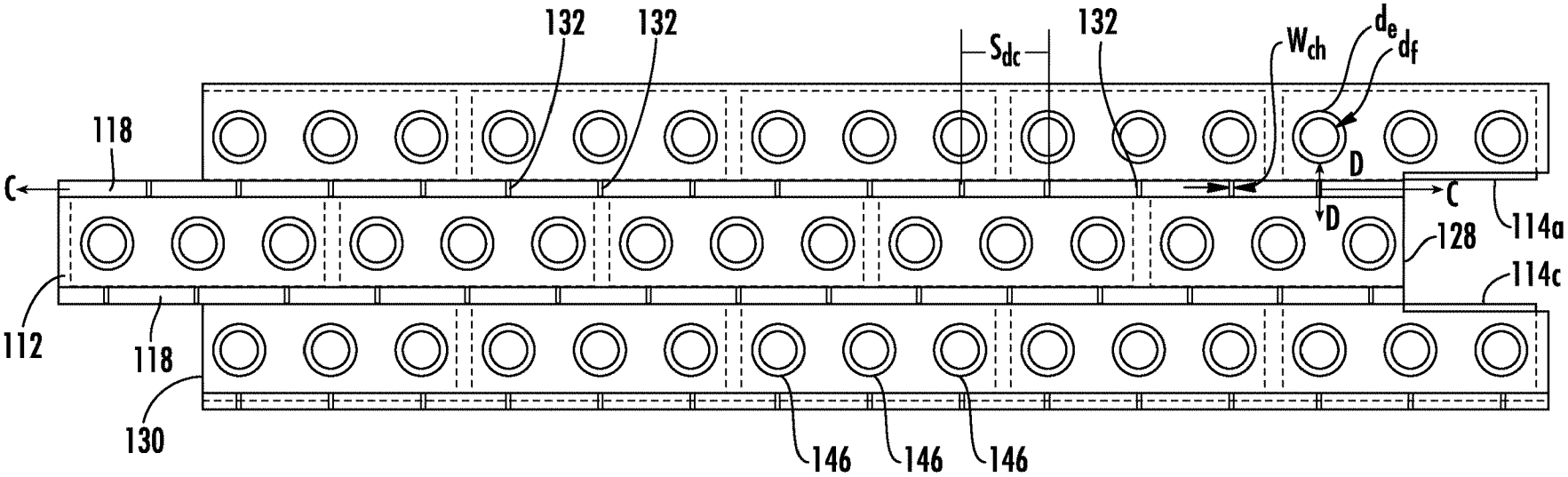
FIG. 3 illustrates a rear view of the wall panel shown in FIG. 1.

In addition, each rib 118 defines one or more drainage channels 132 along the distal surface 126 of the rib 118, according to certain implementations. The drainage channels 132 extend vertically along the ribs 118, relative to the supporting wall upon installation of the wall panel 100 on the supporting wall, to allow moisture between the wall panel 100 and the supporting wall to flow. In implementations in which there are a plurality of drainage channels 132, the drainage channels 132 may be spaced apart from each other along the width of the rib 118. In particular, as shown in FIG. 3, a longitudinal axis D-D of each drainage channel 132 extends in a direction between the upper edge 120 and the lower edge 122. For example, the longitudinal axis D-D may extend parallel to a plane that includes the backing surface 112 and substantially perpendicular to axis C-C of the respective rib 118. In other implementations, the axis D-D may extend at another angle relative to the plane that includes the backing surface 112 and/or at another angle relative to the axis C-C of the respective rib 118 to allow moisture to flow behind the panel 100. Furthermore, according to some implementations, the width $w_{ch}$ and thickness $t_{ch}$ of each drainage channel 132 may be about ⅛ inches, and the drainage channels 132 may be spaced apart $s_{dc}$ about 2.71 inches from center to center along the ribs 118.

In some implementations, the design elements 114 are separately formed from the facing surface 110 and are coupled to the facing surface 110. In another implementation, adjacent channels 122 may define a recessed portion between the channels 116 on the facing surface 110 that is shaped to receive an inner surface of respective design element 114. And, in other implementations, the design elements may be formed integrally with the facing surface, such as in a monolithic structure.

The wall panel 100 also includes a lower edge surface 136 adjacent the lower edge 122 having a first thickness and an upper edge surface 138 adjacent the upper edge 120 having a second thickness, according to certain implementations. The lower edge surface 136 and the upper edge surface 138 are opposite and spaced apart from each other, and an edge rib 140 extends from the backing surface 112 adjacent the lower edge surface 136 in a direction parallel to the first and second directions. The edge rib 140 and/or the lower edge surface 136 define a groove 142, and a plane that is parallel to the backing surface 112 extends through a central portion of the groove 142. The upper edge surface 138 defines a tongue 144 that extends outwardly from the upper edge surface 138 in a direction parallel to the backing surface 112. And, the tongue 144 of a first wall panel 100 is configured for engaging the groove 142 of a second wall panel 100. In other implementations, the tongue and groove may not be included. Furthermore, in other alternative implementations, the edge rib may be extend adjacent the upper edge surface 138 instead of adjacent the lower edge surface 136 and define the groove 142, and the lower edge surface 136 may define the tongue 144. In addition, according to some implementations, a height $h_t$ of the tongue 144 and of the groove 142 may be about 0.21 inches, a thickness $t_t$ of the tongue 144 and of the groove 142 as measured at the thickest part of each may be about 0.31 inches, and a height $h_{er}$ of the edge rib 140 measured at its proximal surface may be about 0.5 inches.

In addition, upon installation of the wall panel 100 on the supporting wall, the ribs 118 and the edge rib 140 are disposed against the supporting wall, and the ribs 118, the edge rib 140, and the backing surface 112 between adjacent ribs 118 and between the edge rib 140 and the rib 118 adjacent thereto define air gaps with the supporting wall. In other implementations (not shown), the groove is defined by the upper edge surface 138 and/or an edge rib that extends adjacent the upper edge surface 138, and the tongue is defined by the lower edge surface 136.

In the implementation shown in FIGS. 1 through 4, the design elements 114 are separately formed from the base substrate that includes the facing surface 110 and backing surface 112. For example, the design elements 114 may be formed of clay, wood, stone, plastic, concrete, ceramic, or other suitable materials. In addition, the base substrate may be formed of a poly ash material, wood, concrete, or other suitable material. In addition, the design elements 114 may be secured to the facing surface 110 using adhesives, such as moisture cured urethane, hot melt, epoxy, a two part urethane adhesive, or other suitable adhesive or fastening mechanism. Alternatively, the base substrate may be cast around the design elements 114, which may eliminate the need for a separate mechanism for coupling the design elements 114 to the base substrate.

The backing surface 112 and facing surface 110 may also define at least one opening 146 extending through the wall panel 100. A central axis of each opening 146 extends through one of the design elements 114. As such, the design elements 114 hide the openings 146 when the wall panel 100 is installed on the wall structure. In addition, the openings 146 may taper in diameter from the backing surface 112 toward the facing surface 110 to allow for easier molding and demolding. For example, the backer openings 146 may have a diameter $d_b$ of about 1.61 inches adjacent the backing surface 112 and a diameter $d_f$ of about 1.5 inches adjacent the facing surface 110.

The openings 146 reduce the amount of material used for the wall panel 100, which reduces the weight of the wall panel 100, and provides more surface area for the adhesive that is used to secure the design elements 114 to the facing surface 110 of the wall panel 100. However, in other implementations, the wall panel 100 may include one or more openings behind each design element 114, the wall panel 100 may include one or more openings behind some but not all of the design elements 114, or the wall panel 100 may not include any openings behind the design elements 114.

The wall panel 100 may have a relatively thin thickness between the facing surface 110 and the backing surface 112 as compared to known wall panels, according to some implementations. Thinner panels typically use less material and weigh less. For example, the wall panel 100 may have a thickness $t_t$ as measured between the facing surface 110 and the backing surface 112 of between about ⅛ inches to about 1 inch. In addition, a thickness $t_r$ defined between the proximal surface 124 of each rib 118 and the distal surface 126 of each rib 118 is between about ⅛ inches and about 1 inch. And, an overall thickness of the wall panel 100 between the facing surface 110 and the distal surface 126 of each rib 118 is between about ¼ and about 2 inches. In some implementations, the height $h_p$ of the panel 100 may be about 10.01 inches. In addition, the design elements 114 may be relatively thin as compared to known design elements. For example, a thickness $t_b$ of each design element 114 may be about ⅝ inches.

Side edges of the wall panel 100 and/or design elements adjacent the side edges may form a discontinuous profile. In particular, the side edges 128, 130 shown in FIGS. 1 through 4 form a discontinuous profile because the design elements 114 in adjacent courses are arranged at an offset to each other. For example, in the implementation shown in FIGS. 1 and 3, a left side edge 128 of the panel 100 adjacent the second course of design elements **114*b* aligns with a center of the leftmost design element 114*a* in the first course and the leftmost design element 14*c* in the third course. And, a right side edge 130 of the design element 114*e* in the first course and the right side edge 130 of the design element 114*g* in the third course align with each other and a center of the rightmost design element 114*f* in the second course. The staggered edge may be formed by the panel 100 and/or the design elements 114**. By staggering the edges of these courses, horizontally adjacent wall panels may be installed together to provide a staggered masonry installation appearance.

In addition, to further enhance the appearance of a masonry installation, a lower left corner of the design element **114*a* in the first course and an upper left corner of the design element 114*c* in the third course may extend outwardly relative to the left side edge 128. This extended portion of each design element 114*a*, 114*c* overlaps a portion of the facing surface 110 adjacent the right side edge 130 of a horizontally adjacent panel 100. In addition, the left edges of design elements 114***a* and 114*c* and the left side edge 128 define a vertical channel therebetween, and the right edges of design elements 114*e* and 114*g* extend to the right side edge 130 of the panel 100. And, the left side edge of the design element 114*b* in the second course extends to the left side edge 128 of the panel 100 adjacent thereto, and the right side edge of the design element 114*f* in the second course and the right side edge 130 of the panel 100 adjacent thereto define a vertical channel therebetween. The width of the vertical channels are substantially equal to the width of the vertical channels defined between adjacent design elements 114 on the panel between the side edges 128, 130 such that when the left edge 128 of one panel 100 is installed horizontally adjacent the right edge 130 of another panel 100, the width between the design elements 114 on adjacent panels 100 is maintained.

In alternative implementations, the design elements 114*a* and 114*c* do not overhang the left side edge 128. For example, in one implementation, the left most edges of design elements 114*a*, 114*b*, and 114*c* stop short of the left edge 128 a distance substantially equal to half of the width of the channels defined between adjacent design elements 114 on the panel between side edges 128, 130. Similarly, the right most edges of design elements 114*e*, 114*f*, and 114*g* stop short of the right edge 13 a distance substantially equal to half of the width of the channels defined between adjacent design elements 114 on the panel between side edges 128, 130. By installing the left edge 128 of one panel 100 against the right edge 130 of a horizontal adjacent panel 100, the distance between horizontally adjacent design elements 114 is substantially the same across two or more panels 100.

Figure 5:
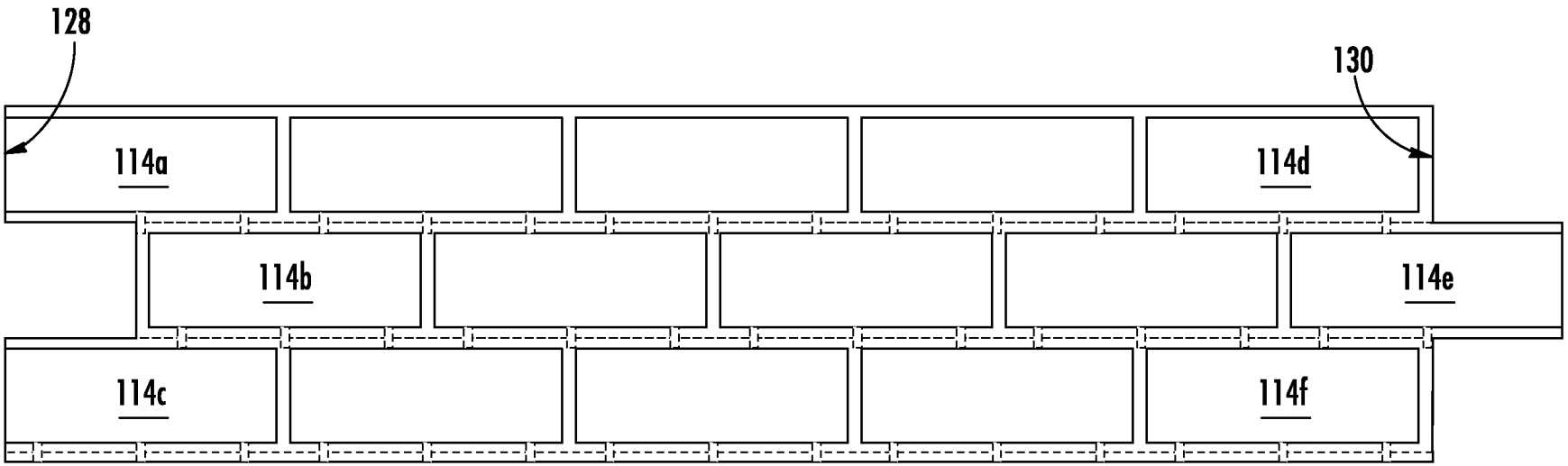
FIG. 5 illustrates a front view of a wall panel according to another implementation.

In other implementations, the left most edges of one or more of design elements 114*a*, 114*b*, and 114*c* may stop short of the left edge 128 by a distance substantially equal to the width of the channels defined between adjacent design elements 114 on the panel between the side edges 128, 130, and the right most edges of one or more of design elements 114*e*, 114*f*, and 114*g* may extend to the right edge 130, or vice versa. For example, in the implementation shown in FIG. 5, the left most edges of design elements 114*a* and 114*c* extend to the left edge 128 of the panel 100, and the left most edge of design element 114*b* is spaced apart from the left edge 128 by the distance substantially equal to the width of the channels defined between adjacent design elements 114. In addition, the right most edges of design elements 114*d* and 114*f* are spaced apart from the right edge 130 by the distance substantially equal to the width of the channels defined between adjacent design elements 114, and the right most edge of design element 114*e* extends to the right edge 130.

The width of the panel 100 may vary depending on installation requirements and the desired look of the panels, but in the exemplary implementation shown in FIG. 1, the width $w_{pu}$ of the panel 100 between the side edges 128, 130 of the uppermost course may be about 40⅝ inches, and the width of the panel $w_{ps}$ between the side edge 128 of the uppermost course and the side edge 130 of the course just below it may be about 44 3/16 inches.

Figure 4:
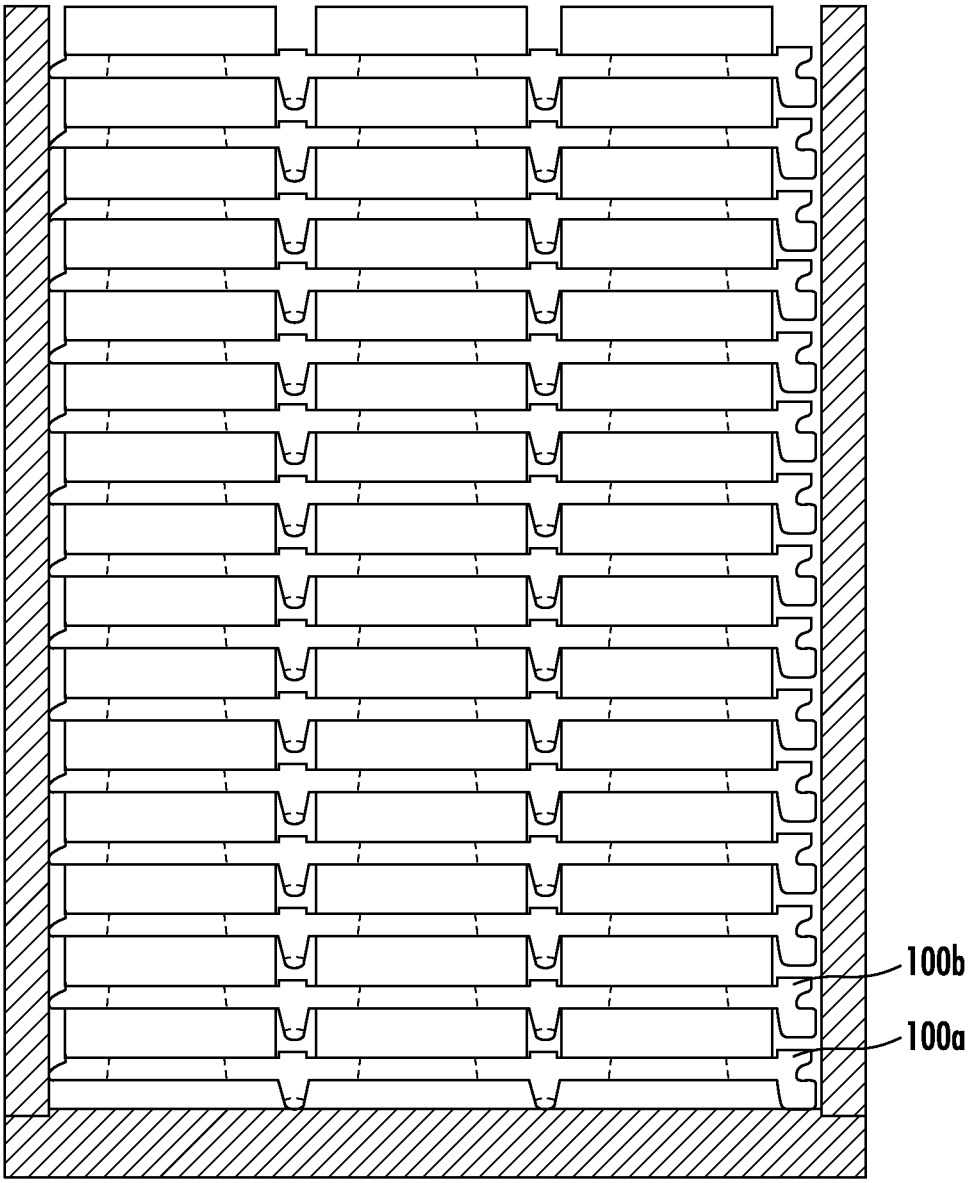
FIG. 4 illustrates an end view of a plurality of wall panels according to the implementation shown in FIG. 1 that are stacked together.

Furthermore, as shown in FIG. 4, the geometry of the wall panels 100 described above allows multiple wall panels 100 to be stacked together for shipment in a manner that prevents damage of the panels 100. In particular, a first wall panel 100*a* is stacked such that the ribs 118, 140 are disposed on the shipping pallet 200, and a second wall panel 100*b* is stacked above the first wall panel 100*a*. The ribs 118 of the second wall panel 100*b* are disposed between the design elements 114 of the first wall panel 100*a*, and the backing surface 112 between the ribs 118 engages the design elements 114. This stacking arrangement reduces the space taken up by a plurality of stacked wall panels and prevents them from moving relative to each other during shipment, which prevents them from breaking.

During installation, the panels 100 may be cut along the horizontal channels 116 to provide a specific height needed. In addition, after the fasteners are engaged through the panels 100, a joining material, such as mortar, grout, caulk, plastic, or other suitable material, may be disposed within the vertical channels and horizontal channels 116 between the design elements 114 to hide the fasteners and joints between adjacent panels 100 and to provide an aesthetically pleasing look.

While the foregoing description and drawings represent the certain implementations of the present invention, it will be understood that various additions, modifications, combinations and/or substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. In addition, features described herein may be used singularly or in combination with other features. The presently disclosed implementations are, therefore, to be considered in all respects as illustrative and not restrictive, the scope of the invention being indicated by the appended claims and not limited to the foregoing description.

It will be appreciated by those skilled in the art that changes could be made to the implementations described above without departing from the broad inventive concept thereof. It is understood, therefore, that this invention is not limited to the particular implementations disclosed, but it is intended to cover modifications within the spirit and scope of the present invention, as defined by the following claims.

The invention claimed is:

1. A wall panel for installation on a supporting wall, the wall panel comprising:

a facing surface comprising at least one design element integral with the facing surface and extending outwardly in a first direction; and a backing surface comprising a plurality of ribs extending in a second direction opposite the first direction, wherein the plurality of ribs includes a first rib and a second rib extending laterally adjacent to each other continuously across an entire width of the wall panel, each rib having a longitudinal axis, and the longitudinal axes of the plurality of ribs extending parallel to each other, and wherein the first rib and the second rib each define a plurality of drainage channels spaced apart and extending along an axis perpendicular to the longitudinal axes of the ribs, each drainage channel of the first rib being laterally offset from each drainage channel of the second rib.

2. The wall panel of claim 1, wherein the longitudinal axes of the plurality of ribs extend parallel to an upper edge or a lower edge of the wall panel.

3. The wall panel of claim 1, wherein the longitudinal axes of the plurality of ribs extend at an angle between 0° and 90° relative to an upper edge or a lower edge of the wall panel.

4. The wall panel of claim 1, further comprising a lower edge surface having a first thickness and an upper edge surface having a second thickness, the lower edge surface and the upper edge surface being opposite and spaced apart from each other, wherein an edge rib extends from one of the lower edge surface or the upper edge surface in a direction parallel to the first and second directions.

5. The wall panel of claim 4, wherein the edge rib defines a groove, a second plane that is parallel to the backing surface extends through a central portion of the groove, and the other of the lower edge surface or upper edge surface defines a tongue that extends outwardly from the other edge surface in a direction parallel to the second plane, wherein the tongue of a first wall panel is configured for engaging the groove of a second wall panel.

6. The wall panel of claim 1, wherein the backing surface and the facing surface define at least one opening extending through the wall panel, a central axis of the at least one opening extending through the at least one design element.

7. The wall panel of claim 6, wherein the backing surface and the facing surface define at least two openings behind the at least one design element.

8. The wall panel of claim 6, wherein the at least one opening has a first diameter at the backing surface and a second diameter at the facing surface, and the first diameter is larger than the second diameter.

9. The wall panel of claim 1, wherein at least one of the first rib or the second rib comprises a proximal surface adjacent the backing surface and a distal surface spaced apart from the proximal surface, a thickness of the at least one of the first rib or the second rib at the proximal surface being greater than a thickness of the at least one of the first rib or the second rib at the distal surface.

10. The wall panel of claim 9, wherein at least one of the first rib or the second rib defines a trapezoidal shaped cross section as viewed from a side edge of the wall panel.

11. The wall panel of claim 1, wherein a thickness defined between the facing surface and the backing surface is between about ⅛ inches to about 1 inch.

12. The wall panel of claim 11, wherein a thickness defined between a proximal surface of at least one of the first rib or the second rib and a distal end of the at least one of the first rib or the second rib is about ⅛ inches to about 1 inch.

13. The wall panel of claim 11, wherein an overall thickness of the wall panel between the facing surface and a distal end of at least one of the first rib or the second rib is about ¼ to about 2 inches.

14. The wall panel of claim 1, wherein the at least one design element includes a plurality of design elements, and a channel between two adjacent design elements includes a plurality of visual markers, each visual marker being disposed opposite a rib of the plurality of ribs.

15. The wall panel of claim 14, wherein the visual markers are spaced apart at regular intervals along the width of the wall panel.

16. The wall panel of claim 1, wherein the at least one design element includes a plurality of design elements, and wherein at least one of the first rib or the second rib is disposed opposite at least a portion of a channel between two adjacent design elements, such that a plane extending parallel to the first and second directions extends through a central portion of the channel and the at least one of the first rib or the second rib.

17. A wall panel for installation on a supporting wall, the wall panel comprising:

a facing surface comprising a plurality of design elements and a plurality of channels between adjacent design elements, each design element of the plurality of design elements extending in a first direction; and a backing surface comprising a first rib and a second rib each extending in a second direction opposite the first direction, wherein:

each of the first rib and the second rib extends continuously across an entire width of the wall panel and has a longitudinal axis, the longitudinal axes of the first rib and the second rib extending parallel and laterally adjacent to each other, each of the first rib and the second rib defines a plurality of drainage channels spaced apart and extending along an axis perpendicular to the longitudinal axes, each drainage channel of the first rib being laterally offset from each drainage channel of the second rib, and each channel of the facing surface includes a plurality of visual markers spaced apart from each other, each visual marker being disposed opposite a corresponding rib of the plurality of ribs of the backing surface.

18. A wall panel for installation on a supporting wall, the wall panel comprising:

a facing surface comprising a plurality of design elements formed integrally with the facing surface and a plurality of channels between adjacent design elements, each design element of the plurality of design elements extending in a first direction; and a backing surface comprising a first rib and a second rib each extending in a second direction opposite the first direction, wherein each of the first rib and the second rib extends continuously across an entire width of the wall panel, the first rib being adjacent to the second rib in a lateral direction;

wherein each of the first rib and the second rib defines a plurality of drainage channels spaced apart and extending along an axis perpendicular to the longitudinal axes, each drainage channel of the first rib being laterally offset from each drainage channel of the second rib, and wherein each channel of the facing surface includes a plurality of visual markers spaced apart at regular intervals along the width of the wall panel, each visual marker being disposed opposite the first rib or the second rib of the backing surface, such that a plane extending parallel to the first and second directions extends through a central portion of the channel and the corresponding first rib or second rib.

* * * * *